US008056182B2

(12) United States Patent
Day

(10) Patent No.: US 8,056,182 B2
(45) Date of Patent: Nov. 15, 2011

(54) HEATING SYSTEM FOR A PORTABLE CARPET EXTRACTOR

(75) Inventor: H. Stephen Day, Mansfield, TX (US)

(73) Assignee: Tacony Corporation, Fenton, MO (US)

( * ) Notice: Subject to any disclaimer, the term of this patent is extended or adjusted under 35 U.S.C. 154(b) by 1329 days.

(21) Appl. No.: 11/215,698

(22) Filed: Aug. 30, 2005

(65) Prior Publication Data

US 2007/0044269 A1 Mar. 1, 2007

(51) Int. Cl.
*A47L 7/04* (2006.01)

(52) U.S. Cl. ..... 15/321; 15/412

(58) Field of Classification Search ..... 15/321, 15/320, 337, 410, 412
See application file for complete search history.

(56) References Cited

U.S. PATENT DOCUMENTS

| | | | | |
|---|---|---|---|---|
| 4,109,340 | A | 8/1978 | Bates | |
| 4,593,753 | A | 6/1986 | McConnell | |
| 4,657,487 | A * | 4/1987 | Schonwald et al. | 417/68 |
| 4,940,082 | A | 7/1990 | Roden | |
| 4,949,424 | A | 8/1990 | Shero | |
| 4,974,282 | A | 12/1990 | Stoltz et al. | |
| 4,991,254 | A | 2/1991 | Roden et al. | |
| 5,265,318 | A * | 11/1993 | Shero | 29/447 |
| 5,371,918 | A | 12/1994 | Shero | |
| 5,983,442 | A * | 11/1999 | Louis et al. | 15/320 |
| 6,041,472 | A * | 3/2000 | Kasen et al. | 15/355 |
| 6,081,962 | A * | 7/2000 | Kasen et al. | 15/353 |
| 6,108,860 | A * | 8/2000 | Crouser et al. | 15/321 |
| 6,131,237 | A * | 10/2000 | Kasper et al. | 15/320 |
| 6,134,744 | A * | 10/2000 | Kasen et al. | 15/320 |
| 6,167,586 | B1 * | 1/2001 | Reed et al. | 15/320 |
| 6,192,549 | B1 * | 2/2001 | Kasen et al. | 15/337 |
| 6,200,108 | B1 * | 3/2001 | Caudill et al. | 417/366 |
| 6,279,196 | B2 * | 8/2001 | Kasen et al. | 15/320 |
| 6,286,180 | B1 * | 9/2001 | Kasper et al. | 15/320 |
| 6,836,928 | B2 | 1/2005 | Zahuranec et al. | |
| 6,898,820 | B2 * | 5/2005 | Kasper et al. | 15/320 |
| 2001/0002500 | A1 * | 6/2001 | Kasen et al. | 15/320 |
| 2004/0117939 | A1 * | 6/2004 | Boone et al. | 15/321 |
| 2005/0022333 | A1 * | 2/2005 | McDowell et al. | 15/320 |
| 2005/0055793 | A1 | 3/2005 | Hauff et al. | |
| 2005/0060837 | A1 * | 3/2005 | Johnson et al. | 15/410 |

* cited by examiner

*Primary Examiner* — Randall Chin
(74) *Attorney, Agent, or Firm* — Charles D. Gunter, Jr.

(57) ABSTRACT

A portable extractor apparatus is shown which includes a wheel mounted base having a solution tank for dispensing and recovering cleaning solution. A cleaning wand is connected to the solution tank and has a head which contacts the surface to the cleaned for dispensing and recovering cleaning solution. A fluid pump circulates cleaning solution in a path between the solution tank and the cleaning head. A vacuum motor provides a vacuum source for the cleaning head for suctioning the surface being cleaned and has an exhaust fan for exhausting excess heat created by the operation of the vacuum motor. A fluid operated heat exchanger is mounted in the vicinity of the vacuum motor. The heat exchanger is plumbed in the circulation path of the cleaning fluid, whereby excess heat generated by the vacuum motor is transferred to the cleaning fluid being applied from the cleaning head onto the surface to be cleaned. The cleaning head can also be integrally mounted on the wheel mounted base.

8 Claims, 3 Drawing Sheets

HEATING SYSTEM FOR A PORTABLE CARPET EXTRACTOR

BACKGROUND OF THE INVENTION

1. Field of the Invention

The present invention relates to a portable machine for cleaning planar surfaces, such as carpeted floors, upholstery, wall coverings and the like, and finds particular application in such machines where hot cleaning liquids are sprayed onto the surface and are then removed by suction.

2. Description of the Prior Art

Cleaning systems that circulate and spray liquids are widely used for cleaning carpets, upholstery, fabric and wall coverings, as well as for hard surfaces such as ceramics. Cleaning systems of this type which circulate and spray liquids often include a solution tank of liquid cleaning solution supported on a wheel mounted base or framework. The framework also supports a liquid pump for circulating the cleaning solution and one or more vacuum motors for recovering the solution and returning the used solution to a recovery tank. Many of these systems use a "cleaning head" which is part of a "cleaning wand" to spray liquid cleaning solution toward the surface being cleaned, for example, while the cleaning head is being pushed across the floor. In many such systems, the cleaning head is not integral with the base or framework, but rather is coupled to the solution tank through pliable hosing and the associated cleaning wand, which is thus is movable independently. On the return stroke across the floor, a vacuum source creates a high velocity airstream that draws the dispensed liquid from the surface being cleaned upwardly into an internal chamber of the cleaning head and through the pliable hosing to the recovery tank, thereby extracting soil, debris and other foreign matter to clean the surface. The spray operation of this type device is thus "on-and-off" in its nature.

A variety of devices of the above type are known in the relevant industries. For example, a commercially available line of carpet extractors of the above general type is sold as the "PFX1350 Series Extractors" byPowr-Flite®, a Tacony Company, 3101 Wichita Court, Fort Worth, Tex., 76140.

Alternatively, a surface cleaning apparatus can be self-contained, in the sense of providing a wheel supported housing that incorporates the necessary motors and contains the cleaning fluid, and further incorporates the cleaning tool head as a part of the same housing, for example, through a pair of pivot arms. In other words, the cleaning head is attached to the machine housing and rolls across the floor with the housing. These type machines are typically operated in a constantly "on" fashion. This type of cleaning apparatus is described in U.S. Pat. No. 5,432,975 (Hilmanowski), issued Jul. 18, 1995, and in any number of other references.

The aforementioned devices, whether of the hose and wand variety, or of the self-contained housing variety, all utilize vacuum motors to draw up the dispensed cleaning solution from the surface being cleaned so that the used cleaning solution can be returned to the solution recovery tank. The vacuum motors which are mounted on the wheel mounted base or framework are often electrically powered from AC current and generate a good deal of heat. As a result, the motors typically feature some sort of exhaust chamber or shroud and may feature an exhaust fan or other heat exhaust arrangement to distribute or remove the excess heat generated by the vacuum motors. For example, the previously mentioned PFX1350 Extractor may be equipped with a 115 VAC, 104 cfm, 2 stage vacuum motor, or with a 120 VAC 3 stage vacuum motor. The heat generated by these motors has, in the past, been simply exhausted and in a sense wasted.

Heated cleaning solutions generally clean more effectively than unheated solutions. As a result, certain of the prior art portable machines have included heating components for the cleaning solution which is subsequently sprayed onto the surface to be cleaned and then suctioned back into a recovery tank. Many of these devices have utilized an electrical heater to heat the fluid to be applied to a given temperature before it is applied to the surface which is to be cleaned.

While carpet extractors utilizing axillary heating devices have been known and used successfully for a number of years, there are various shortcomings attendant with these prior art assemblies. As a general matter, the prior art devices utilizing electric solution heaters have required increased AC electrical power in order to sufficiently heat the fluids which are to be applied over the amount of power required to simply apply and extract a cold cleaning solution. Because the available electrical outlet capability is necessarily limited in typical residential and commercial buildings in North America, compromises in temperature rise and/or fluid flow rate must necessarily be made. Sometimes, the increased amperage being drawn has caused the operator to blow electrical fuses in the structure being cleaned. In many cases, it is also not generally practical to utilize multiple electrical cords running to the extractor unit. As a result, one smaller cord may overheat due to the increased electrical load.

To address this perceived shortcoming, various cleaning devices and machines have been introduced and which include self contained power supplies. These devices typically consist of multiple lead-acid batteries which are utilized to supply power to the cleaning device so it may operate remotely relative to an AC power source. While cleaning devices having self contained power sources have operated with some degree of success, the useful operational time of such devices is quite limited. Consequently, an operator must periodically stop these prior art machines either to recharge the batteries utilized with same; or in the alternative, remove the discharged batteries, and replace them with a fully charged set of batteries, so that the machine can continue in operation. Still further, machines of this type which have rechargeable batteries are also relatively large and heavy, and can be difficult to maneuver in small spaces.

A need exists, therefore, for a portable carpet extractor type machine which more effectively utilizes the excess heat generated by the vacuum motor or motors, rather than simply exhausting the excess heat.

A need also exists for such a portable carpet extractor device equipped with a solution heater which would actually allow the vacuum motors to run cooler, while at the same time supplying heated cleaning solution for more efficient cleaning.

A need also exists for such an improved carpet extractor which either eliminates the need for a separate electric solution heater, or which acts to supplement the solution heating process so that less power is required for the electric heater where such a heater is present.

A need exists for such a device which would provide adequate heat to break down grease and enhance the cleaning process without requiring additional power cords or power consumption and which would not risk damage to the carpet being cleaned.

A need also exists for such a device which would maintain its heat over an extended period of time, which would be simple and dependable in operation and which would not add significantly to the overall cost of the extractor device.

SUMMARY OF THE INVENTION

Therefore, an extractor apparatus which overcomes many of the perceived shortcomings of the prior art devices and practices is the subject matter of the present application. The portable extractor includes a wheel mounted base having at least a solution tank for dispensing and recovering cleaning solution. In one embodiment of the invention, a cleaning wand connected to the solution tank by pliable hosing, the cleaning wand having a cleaning head which contacts the surface to the cleaned for dispensing and recovering cleaning solution. A fluid pump circulates cleaning solution in a path between the solution tank and the cleaning head of the wand. A vacuum motor comprises a vacuum source for the extractor apparatus, the vacuum source being in communication with the cleaning head of the wand for suctioning the surface being cleaned. The vacuum motor is mounted on the base and exhausts excess heat during normal operation. A fluid operated heat exchange means is mounted on the base in heat transfer relation with the vacuum motor for circulating a fluid heat exchange medium in the vicinity of the vacuum motor, whereby excess heat generated by the vacuum motor is transferred to the fluid heat exchange medium. The fluid heat exchange medium which is being circulated is preferably cleaning solution which is passing between the solution tank and the cleaning head of the wand, whereby the cleaning solution is heated by the excess heat generated by the vacuum motor. The heated cleaning solution is dispensed onto the surface to be cleaned and cleans more effectively than unheated solution. Preferably, the extractor apparatus is a carpet extractor used to extract soil from a carpeted planar surface which uses a vacuum motor powered by an AC source.

In another embodiment of the invention, the cleaning head is provided as an integral part of the wheel mounted base. As the machine moves across the floor or other surface being cleaned, the cleaning head contacts the surface. Otherwise, the fluid operated heat exchange means and the fluid heat exchange medium operate in the same manner as previously described.

The improved cleaning method of the invention employs the previously described carpet extractor apparatus for cleaning a carpeted surface. Cleaning solution is dispensed from the solution tank to the cleaning head of the cleaning wand or to a cleaning head carried on the base of the extractor. Exhaust heat from the vacuum motor is used to heat the cleaning solution, either on its way to the cleaning head, or in the solution tank itself. In the case of the wand and flexible hose extractor arrangement, the cleaning solution is dispensed from the solution tank in a fluid dispensing operation while moving the cleaning head in a first direction relative to a user. The fluid dispensing operation is then stopped, followed by moving the cleaning head in an opposite direction relative to the user while applying a vacuum to the cleaning head to recover cleaning solution from the surface being cleaned. In the case of the extractor having the cleaning head mounted integrally with the base, the fluid dispensing and vacuuming operations are constantly on in use.

Additional objects, features and advantages will be apparent in the written description which follows.

DETAILED DESCRIPTION OF THE INVENTION

Figure 1:
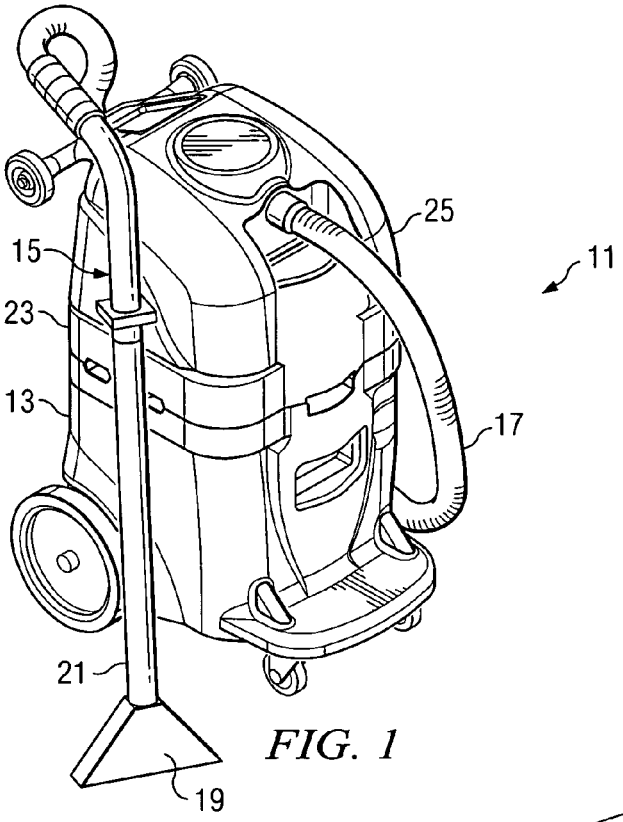
FIG. 1 is a perspective view of a portable carpet extractor employing the heating system of the invention, showing the cleaning wand and the associated wheel supported base which houses the cleaning fluid solution tank and recovery tank and the vacuum source.
Figure 4:
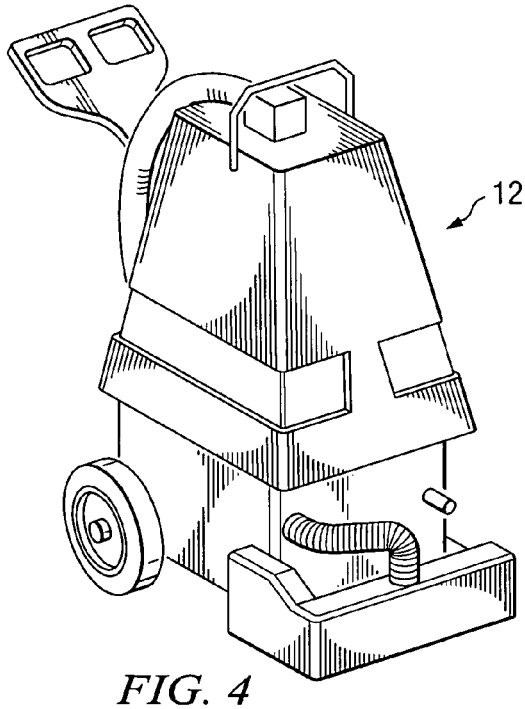
FIG. 4 is a perspective view of an alternative type of carpet extractor which employs a cleaning head integrally mounted on the wheeled base.

Turning to FIG. 1, there is shown an apparatus for cleaning a planar covered surface of the invention designated generally as 11. The surface to be cleaned can be, for example, a carpeted surface, a wall covering, upholstery, or the like. In the first embodiment of the invention illustrated in FIG. 1, the apparatus 11 is a carpet extractor of the type used to remove soil from the carpeted surface which features a first type of cleaning head carried on a wand and an interconnecting length of flexible hosing which connects the wand to the base unit. With reference briefly to FIG. 4, another type carpet extractor is shown which features a second type of integrally mounted cleaning head (12 in FIG. 4) which moves across the floor surface as the machine itself is moved back and forth. As will be apparent in the description which follows, the improved heating system of the invention can be used with either an extractor of the type shown in FIG. 1, or with the extractor shown in FIG. 4. However, for simplicity sake, the details of the invention will be described with reference to the first type extractor shown in FIG. 1.

As shown in FIG. 1, the first embodiment of the extractor of the invention includes a wheel mounted base or framework 13 and a cleaning wand 15 connected to the base by means of pliable hosing 17. The wand is made up of a cleaning head 19 which is supported by a handle assembly 21. As will be familiar to those skilled in the art, the handle assembly 21 supports a cleaning fluid line and vacuum line which fluidly connect the head 19 with a cleaning solution tank 23 carried on the base 13.

Figure 2:
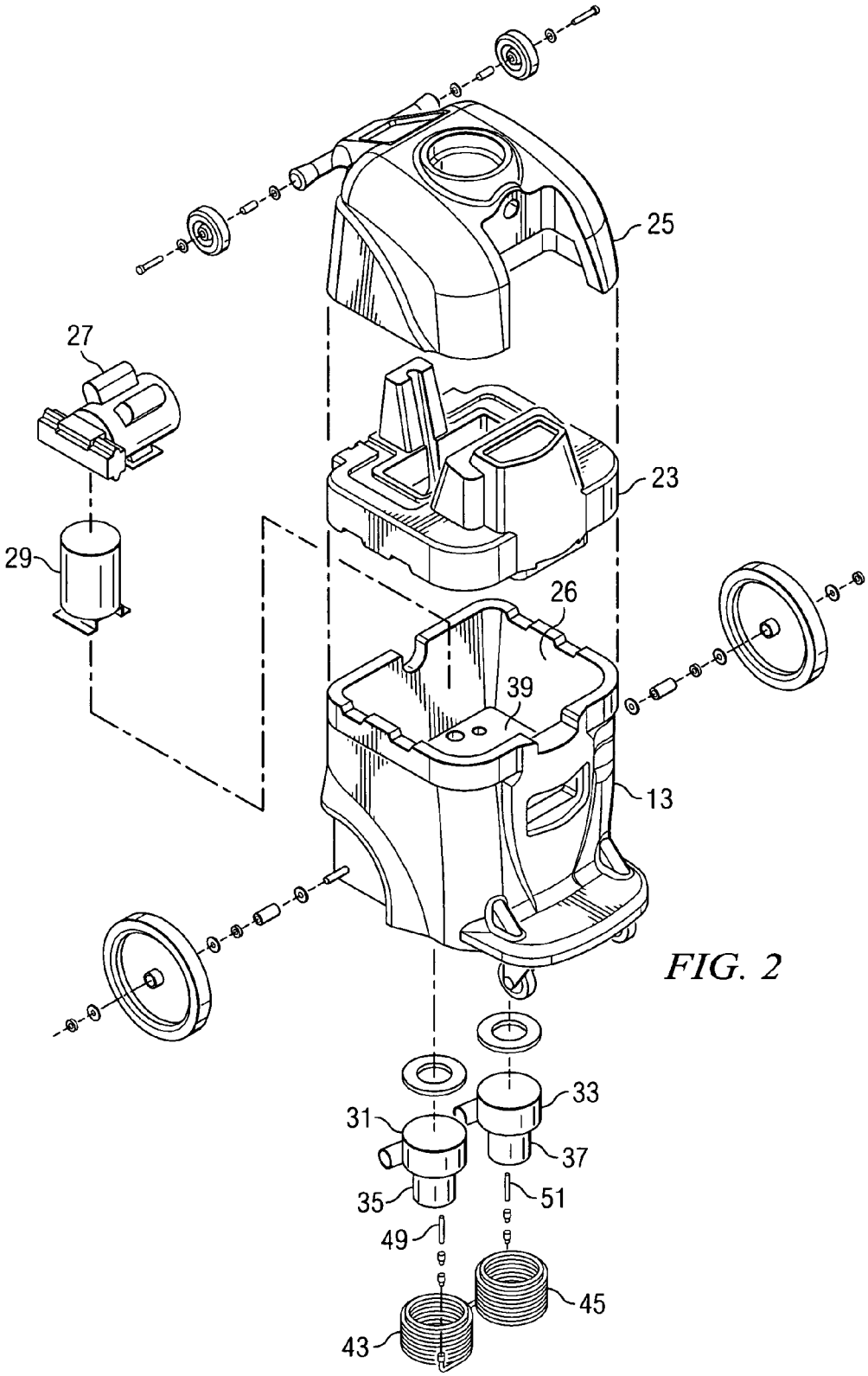
FIG. 2 is a simplified exploded view of the carpet extractor of FIG. 1, showing the principle components thereof.

As better seen in FIG. 2, the wheel mounted base 13 which makes up a part of the particular extractor illustrated actually supports a separate solution tank 23 and a recovery tank 25. The base itself comprises a utility compartment 26 for housing a fluid pump 27 and a separate electrical solution heating component 29. The separate electrical heating component 29 is typically powered by the AC power source to the unit and may feature, for example, a resistive heating element. As shown in FIG. 2, the motor compartment 26 also houses one or more vacuum motors, in this case two motors 31, 33. The vacuum motors 31, 33, in this case are 115 VAC 104 cfm, 2 stage Ametek Lamb® vacuum motors. The described liquid pump 27 used for circulating the cleaning solution from the cleaning solution tank 23 and vacuum motors used for recovering cleaning solution and returning solution to the recovery tank 25 are all conventional and will be familiar to those skilled in the relevant arts.

The vacuum motors 31, 33 comprise a vacuum source for the extractor apparatus 11. The vacuum source is in communication with the cleaning head 19 of the wand 15 for suctioning the surface being cleaned. The vacuum motors each have an exhaust fan 35, 37 associated therewith for exhausting excess heat created by the operation of the vacuum motors.

Figure 3:
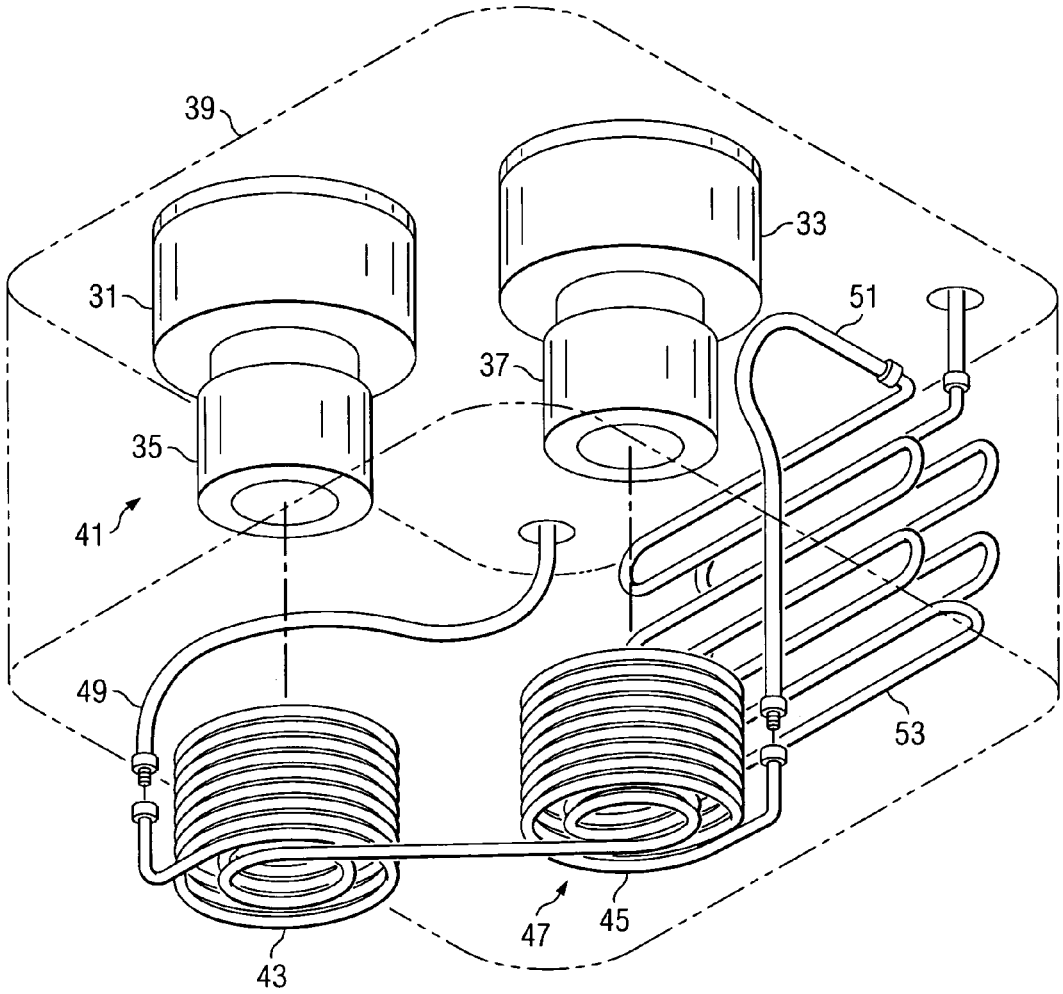
FIG. 3 is an isolated view of the vacuum motor exhaust fans located within the exhaust shroud housing of the device of FIG. 1 showing the heat exchange components of the invention installed thereon.

As seen in FIGS. 2 and 3, the base utility compartment 26 has a bottom compartment wall 39 which divides the utility compartment 26 from an exhaust compartment or shroud 41 (see FIG. 3). As best seen in FIG. 3, the vacuum motors 31, 33 are mounted in a vertical orientation within the utility compartment 26 so that the exhaust fans 35, 37 extend downwardly and protrude into the lower exhaust compartment 41. Even though the particular motors are shown as being vertically mounted, it will be appreciated by those skilled in the relevant arts that the motors could be mounted in other orientations on the housing, for example, horizontally. In the past, the excess heat generated by the vacuum motors 31, 33 either accumulated within the exhaust compartment 41 or was exhausted to the atmosphere by the action of the fans 35, 37.

As best seen in FIG. 3, the carpet extractor apparatus of the invention includes a fluid operated heat exchange means mounted on the base within the exhaust compartment 41 in heat transfer relation with the vacuum motors 31, 33 for circulating a fluid heat exchange medium in the vicinity of the vacuum motors. In this way, excess heat generated by the vacuum motors 31, 33 is transferred to the fluid heat exchange medium. The preferred fluid heat exchange medium which is being circulated is a quantity of the cleaning fluid solution which is passing between the solution tank 23 and the cleaning head of the cleaning wand 15, whereby the cleaning solution is heated by the excess heat generated by the vacuum motors.

In the preferred embodiment of the invention illustrated in FIG. 3, the fluid operated heat exchange means comprises a pair of separate copper tube coils 43, 45 each of which has an internal diameter or opening 47 which is sized to allow the tubing coil to be closely received about the exhaust fan portion 35, 37, respectively of the associated vacuum motor. However, it will be understood that the heat exchange coils 43, 35 could also be located in other locations with respect to the vacuum motors and still pick up the excess heat being generated by the motors.

The fluid heat exchange means further comprises a fluid conduit which is connected to the tubing coils 43, 45 for routing the heat exchange medium to and from the coils. As shown in FIG. 3, the fluid conduits 49, 51 are plumbed into the path of the cleaning solution which is passing between the solution tank 23 and the cleaning head 19 of the wand, whereby the cleaning solution is heated by the excess heat generated by the vacuum motors 31, 33. In this way, the same fluid pump 27 which is used to pump cleaning solution from the solution tank to the wand head is utilized to pump cleaning solution through the conduits 49, 51 and through the heat exchange coils 43, 45. The exact form of the heat exchange apparatus may vary. For example, in the embodiment shown in FIG. 3, there are auxiliary heat exchange loops 53 located within the exhaust compartment 41 in line with the fluid conduit 51. Other heat exchange coil arrangements can be visualized which could be located within the exhaust compartment 41 for effecting heat transfer between the cleaning solution and the hot air within the compartment.

In the method of cleaning a carpeted surface of the invention, a carpet extractor apparatus of the type previously described is provided. The exhaust heat created by the vacuum motors 31, 33 is used to heat the cleaning solution by circulating the cleaning solution in a fluid path in the vicinity of the vacuum motors, whereby excess heat generated by the vacuum motors 31, 33 is transferred to the cleaning fluid. The cleaning solution is dispensed from the solution tank 23 in a fluid dispensing operation while moving the cleaning head 19 of the wand 15 in a first direction relative to a user. The fluid dispensing operation is then stopped, followed by moving the cleaning head 19 in an opposite direction relative to the user while applying a vacuum to the cleaning head 19 to recover cleaning solution from the surface being cleaned to the recovery tank 25.

An invention has been provided with several advantages. The fluid heat exchange means of the invention provides an auxiliary heating system for a portable carpet extractor which provides heat adequate to break down grease and other soil and contaminants to enhance the cleaning process. The apparatus of the invention is capable of providing heat over an extended period of time. Although it can be used with additional electrical cords, it does not require additional cords or add to the power consumption of the existing unit. There is no additional risk of damage to a carpet being cleaned. The device is simple in design and extremely dependable in operation and does add significantly to the cost of the extractor.

Using warm tap water, the improved carpet extractors of the invention can deliver hot water to a surface to be cleaned without the problems introduced by multiple power cords or blown circuit breakers. Water can be heated to the optimum cleaning temperature recommended by carpet manufacturers without risk of damage to the carpet. An exemplary extractor operates at only 14 amps with a single power cord. In addition to supplying hot cleaning solution without requiring additional electrical power, the apparatus of the invention actually allows the vacuum motors to run at a cooler temperature, thereby prolonging the useful life of the motors. The auxiliary heat exchange system of the apparatus of the invention can be used as a stand alone system or can be used to augment the heating capability provided by an existing, separate electric heating unit on the extractor.

While the invention has been shown in only one of its forms, it is not thus limited but is susceptible to various changes and modifications without departing from the spirit thereof.

What is claimed is:

1. A portable extractor apparatus used to clean planar surfaces, the extractor apparatus comprising:

a wheel mounted base having a cleaning solution tank for dispensing cleaning solution and a recovery tank for recovering cleaning solution;

a cleaning wand connected to the solution tank by pliable hosing, the cleaning wand having a cleaning head which contacts the surface to the cleaned for dispensing and recovering cleaning solution;

a fluid pump for circulating cleaning solution in a path between the solution tank and the cleaning head of the wand;

at least one vacuum motor which comprises a vacuum source for the extractor apparatus, the vacuum source being in communication with the cleaning head of the wand for suctioning the surface being cleaned, the vacuum motor having an exhaust fan associated therewith for exhausting excess heat created by the operation of the vacuum motor;

a fluid operated heat exchanger mounted on the base in heat transfer relation with the vacuum motor for circulating a liquid heat exchange medium in the vicinity of the vacuum motor, whereby excess heat generated by the vacuum motor is transferred to air surrounding the vacuum motor, which is in turn transferred to the fluid heat exchanger, the heat transfer process being between two separate and distinct fluids, the liquid heat exchange medium and the air surrounding the vacuum motor;

wherein the liquid heat exchange medium which is being circulated is the cleaning solution which is passing between the solution tank and the cleaning head of the wand, whereby the cleaning solution is heated by the excess heat generated by the vacuum motor;

wherein the fluid operated heat exchanger comprises a tubing coil which is wound about a portion of the vacuum motor so as to be in heat exchange relationship with the vacuum motor; and wherein the fluid operated heat exchanger further comprises a fluid conduit connected to the fluid operated heat exchanger for routing the heat exchange medium to and from the fluid operated heat exchanger, the fluid conduit being plumbed into the path of the cleaning solution which is passing between the solution tank and the cleaning head of the wand.

2. The extractor apparatus of claim 1, wherein the extractor apparatus is a carpet extractor used to extract soil from a carpeted planar surface.

3. The extractor apparatus of claim 2, wherein the vacuum motor is an AC powered motor.

4. A portable carpet extractor apparatus used to clean planar carpeted surfaces, the carpet extractor apparatus comprising:

a wheel mounted base having a cleaning solution tank for dispensing cleaning solution and a recovery tank for recovering cleaning solution;

a cleaning head integrally mounted on the wheel mounted base and connected to the solution tank by a suitable conduit, the cleaning head being arranged to contact the surface to the cleaned for dispensing and recovering cleaning solution;

a fluid pump for circulating cleaning solution in a path between the solution tank and the cleaning head;

at least one vacuum motor which comprises a vacuum source for the extractor apparatus, the vacuum source being in communication with the cleaning head for suctioning the surface being cleaned;

a tubing coil mounted on the base in heat transfer relation with the vacuum motor for circulating a liquid heat exchange medium in the vicinity of the vacuum motor, whereby excess heat generated by the vacuum motor is transferred to air surrounding the vacuum motor, which is in turn transferred to the tubing coil, the heat transfer process being between two separate and distinct fluids, the liquid heat exchange medium and the air surrounding the vacuum motor;

wherein the liquid heat exchange medium which is being circulated is the cleaning solution which is passing between the solution tank and the cleaning head of the wand;

additional plumbing tubing connected to the tubing coil for routing the heat exchange medium to and from the tubing coil, the additional plumbing tubing being in fluid communication with the cleaning solution which is passing between the solution tank and the cleaning head, whereby the cleaning solution is heated by the excess heat generated by the vacuum motor;

wherein the wheel mounted base includes a motor compartment for mounting the vacuum motor and an exhaust compartment located below the motor compartment, and wherein the vacuum motor generates excess heat which is exhausted downwardly into the exhaust compartment; and wherein the tubing coil is located within the exhaust compartment and is wound about a portion of the vacuum motor so as to be in heat exchange relationship with the vacuum motor.

5. The carpet extractor apparatus of claim 4, wherein the additional plumbing tubing is a fluid conduit which connects the tubing coil in the path of the cleaning solution after the solution tank and before the cleaning head.

6. The carpet extractor apparatus of claim 4, wherein the additional plumbing tubing is a fluid conduit which connects the tubing coil with the solution tank to heat the cleaning solution which is located in the solution tank.

7. The carpet extractor apparatus of claim 4, wherein the wheel mounted base also houses a separate electrically powered heating component for heating the cleaning solution.

8. The carpet extractor apparatus of claim 4, wherein the vacuum motor is an AC powered motor.

* * * * *